US009140138B2

(12) United States Patent
Corson

(10) Patent No.: US 9,140,138 B2
(45) Date of Patent: Sep. 22, 2015

(54) TURBOMACHINE CONTAINMENT STRUCTURE

(75) Inventor: Michael A. Corson, Fairfield, CA (US)

(73) Assignee: Hamilton Sundstrand Corporation, Hartford, CT (US)

( * ) Notice: Subject to any disclaimer, the term of this patent is extended or adjusted under 35 U.S.C. 154(b) by 606 days.

(21) Appl. No.: 13/484,651

(22) Filed: May 31, 2012

(65) Prior Publication Data

US 2013/0323008 A1 Dec. 5, 2013

(51) Int. Cl.
*F01D 25/24* (2006.01)
*F01D 21/04* (2006.01)

(52) U.S. Cl.
CPC ..... *F01D 25/24* (2013.01); *F01D 21/045* (2013.01); *F05D 2220/50* (2013.01); *F05D 2250/11* (2013.01)

(58) Field of Classification Search
CPC ..... F05D 2260/311; F05D 2250/11; F05D 2220/50; F01D 25/24; F01D 21/045
USPC ..... 415/213.1, 219.1, 9
See application file for complete search history.

(56) References Cited

U.S. PATENT DOCUMENTS

| | | | | |
|---|---|---|---|---|
| 3,613,360 | A | 10/1971 | Howes | |
| 3,652,176 | A | 3/1972 | Walsh | |
| 3,971,218 | A | 7/1976 | Toth, Jr. et al. | |
| 4,687,412 | A | 8/1987 | Chamberlain | |
| 5,413,456 | A | 5/1995 | Kulak et al. | |
| 5,618,162 | A | 4/1997 | Chan et al. | |
| 5,699,823 | A | 12/1997 | Thomson | |
| 5,899,660 | A * | 5/1999 | Dodd | 415/9 |
| 6,053,696 | A * | 4/2000 | Roberts | 415/9 |
| 6,059,524 | A * | 5/2000 | Costa et al. | 415/9 |
| 6,224,321 | B1 | 5/2001 | Ebden | |
| 6,312,221 | B1 | 11/2001 | Yetka et al. | |
| 6,543,991 | B2 * | 4/2003 | Sathianathan et al. | 415/9 |
| 7,874,136 | B2 | 1/2011 | Heyerman | |
| 2004/0240985 | A1 | 12/2004 | Stephenson et al. | |
| 2005/0074328 | A1 | 4/2005 | Martindale et al. | |
| 2005/0238484 | A1 | 10/2005 | Lawson et al. | |
| 2006/0207827 | A1 | 9/2006 | Williams et al. | |
| 2011/0283711 | A1 * | 11/2011 | Petersson et al. | 60/796 |

FOREIGN PATENT DOCUMENTS

| | | |
|---|---|---|
| EP | 2447157 A2 | 5/2012 |
| WO | 9961757 A1 | 12/1999 |

OTHER PUBLICATIONS

International Search Report and Written Opinion for International Application No. PCT/US2013/039598 completed on Sep. 16, 2013.
International Preliminary Report on Patentability for International Application No. PCT/US2013/039598 mailed Dec. 11, 2014.

* cited by examiner

*Primary Examiner* — Dwayne J White
*Assistant Examiner* — Jason Fountain
(74) *Attorney, Agent, or Firm* — Carlson, Gaskey & Olds, P.C.

(57) ABSTRACT

An exemplary containment structure includes an annular wall configured to receive a rotatable portion of a turbomachine. A plurality of apertures extend radially through the annular wall. The apertures have a varying circumferential width.

19 Claims, 1 Drawing Sheet

TURBOMACHINE CONTAINMENT STRUCTURE

BACKGROUND

This disclosure relates generally to a containment structure and, more particularly, to a frangible containment structure.

Turbomachines extract energy from a flow of fluid as is known. During operation, air is pulled into the turbomachine. The air is then compressed and combusted. The products of combustion expand to rotatably drive a turbine section of the turbomachine.

One example turbomachine is an auxiliary power unit (APU). The typical APU is located in the tail section of an aircraft. The APU provides electrical power and compressed air to the aircraft. Another example turbomachine is a gas turbine engine that propels the aircraft.

During turbomachine operation, a portion of the turbomachine may become separated from other portions of turbomachine. For example, fragments of failed disks may separate from a turbine section of the turbomachine. The separated fragments possess significant kinetic energy and are quite capable of damaging components lying along the fragment's trajectory. Turbomachines typically include containment structures that dissipate energy contained in the separated fragments. Absorbing the energy of the separated fragments is difficult, even when using containment structures.

SUMMARY

An exemplary containment structure includes an annular wall configured to receive a rotatable portion of a turbomachine. A plurality of apertures extend radially through the annular wall. The apertures have a varying circumferential width.

An exemplary turbomachine assembly includes a containment structure circumscribing a rotatable assembly of a turbomachine. An array of apertures extend radially through a wall of the containment structure. The array of apertures provide a frangible joint.

An example method of absorbing loads within a turbomachine includes applying a load to containment structure, and shearing the containment structure at a location of a frangible joint of the containment structure.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
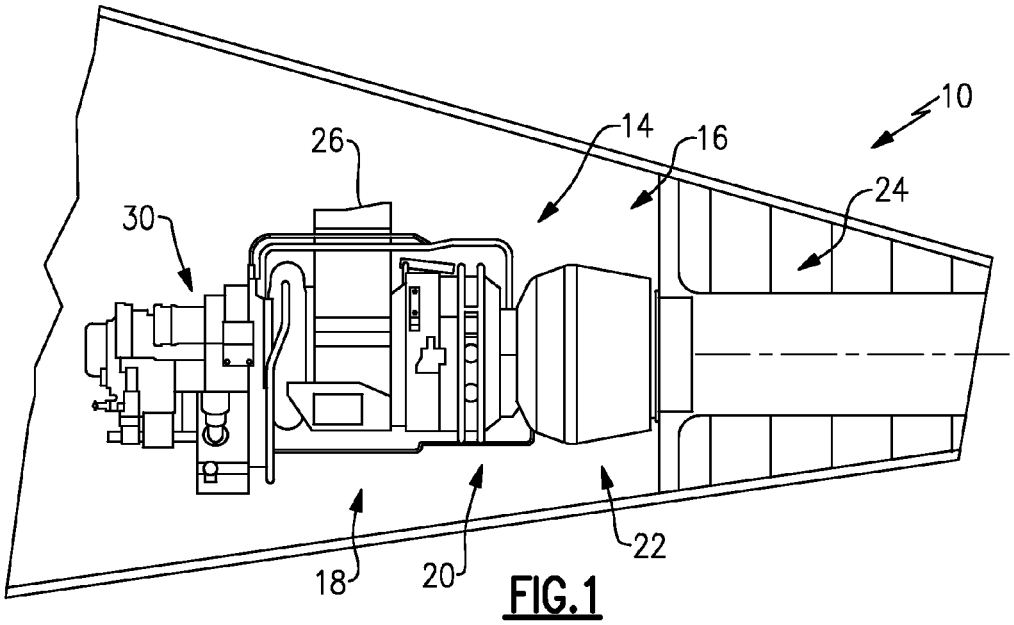
FIG. 1 shows a section view of an example turbomachine.

Referring to FIG. 1, a tail section 10 of an example aircraft houses an auxiliary power unit (APU) 14 within an auxiliary power unit compartment 16. As known, the APU 14 is used to provide power and pressurized air for use in the aircraft.

The APU 14 is a type of turbomachine. Another example turbomachine is a gas turbine engine that is used to propel the aircraft. Although shown in the tail section 10 of the aircraft, a person having skill in this art and the benefit of this disclosure will understand that the APU 14 could be located elsewhere within the aircraft.

The APU 14 generally includes a compressor section 18, a combustor section 20, a turbine section 22, and an exhaust section 24. During operation, air is moved through a plenum 26 to the compressor section 18. The air is compressed in the compressor section 18. A mixture of the compressed air and fuel is ignited within the combustor section 20. The products of combustion are expanded within the turbine section 22 to rotatably drive a generator 30, which provides power to the aircraft. Once expanded, these products are discharged from the APU 14 through the exhaust section 24.

Figure 2:
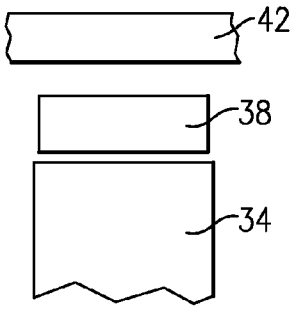
FIG. 2 shows a section view from a turbine section of the turbomachine of FIG. 1.
Figure 3:
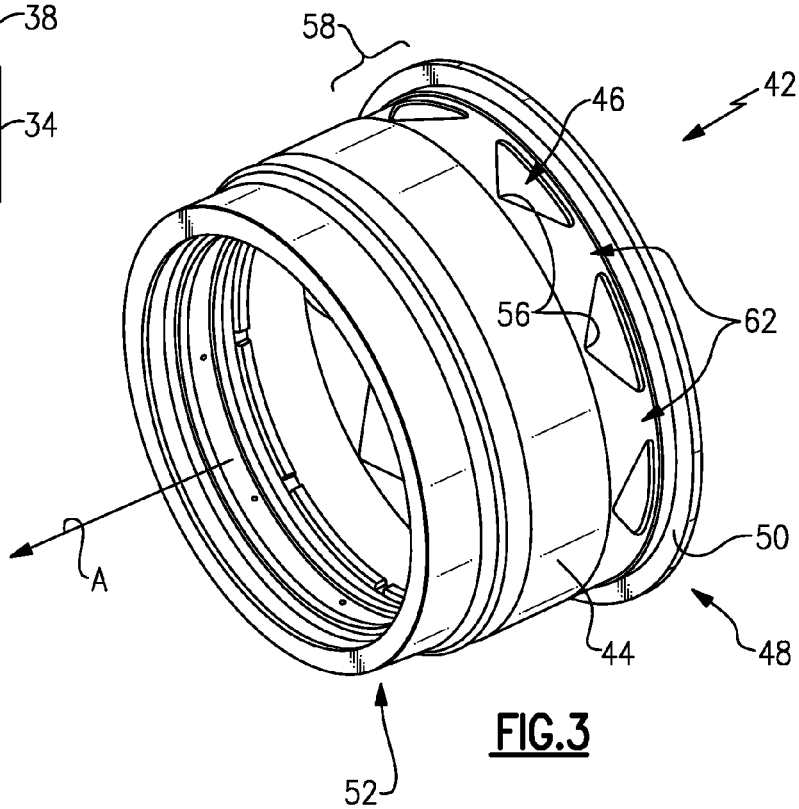
FIG. 3 shows a perspective view of a containment structure of the turbomachine of FIG. 1.

Referring now to FIGS. 2 and 3 with continuing reference to FIG. 1, the turbine section 22 includes turbine blades 34 having tips that seal against a blade outer air seal 38 during operation. A containment structure 42 circumscribes the turbine blades 34 and the blade outer air seal 38. The containment structure 42 captures fragments expelled from structures of the APU 14, such as the turbine blades 34 and the blade outer air seal 38. Fragments may be expelled from structures of the APU 14 during, for example, a turbine failure.

The containment structure 42 may be secured directly to a housing within the combustor section 16, a housing within the exhaust section 24, or some other area. The forces exerted on the containment structure 42 place a large amount of torque on the containment structure 42. The torque may damage the containment structure 42, as well as surrounding components of the APU 14, especially the components that the containment structure 42 is secured to.

The example containment structure 42 includes an annular wall 44 having a plurality of apertures 46. A first axial end 48 of the containment structure 42 includes a collar 50 that is secured directly to the exhaust section 24 of the APU 14. An opposing second axial end 52 of the containment structure 42 is secured directly to the combustor section 20 of the APU 14.

The apertures 46 are distributed circumferentially about a rotational axis A of the APU 14. The apertures 46 of the example containment structure 42 have an arrow- or triangular-shaped profile. Points 56 of the apertures 46 are pointed upstream relative to a direction of flow through the APU 14. The apertures 46 are 45°-45°-90° triangles in this example with the points 56 having the 90° angle.

The points 56 are circumferentially smaller than other areas of the apertures 46. That is, the circumferential width of the apertures 46 is the smallest at the points 56. The apertures 46, in this example, extend from a circumferentially smaller area to a circumferentially wider area.

Areas 58 of the containment structure 42 immediately adjacent apertures 46 are weaker than other areas of the containment structure 42 due to the apertures 46. The weakened area 58 is the most likely area of the containment structure 42 to fail if significant torque is introduced to the containment structure 42. In this example, the containment structure 42 is weakest in areas 62 where the apertures 46 are circumferentially the closest. As appreciated, the cross-sectional area of the containment structure 42 is the smallest at the areas 62.

The apertures 46 establish a frangible joint within the containment structure 42. In some examples, the containment structure 42 shears at the frangible joint. The frangible joint facilitates predictable failure in a desired area of the containment structure 42. Energy imparted to the containment structure 42 by fragments that have separated of the APU 14 can be absorbed in a predictable manner.

Features of the disclosed examples, include encouraging the containment structure 42 to fail in a particular area to help contain these forces and avoid damaging other portions of the APU 14 or aircraft. The triangular shape of the example apertures encourage failure in a particular area, minimize the overall weight of the containment structure, and provide enhanced structural properties (lateral and torsional stiffness).

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

I claim:

1. A containment structure, comprising:

an annular wall configured to receive a rotatable portion of a turbomachine; and a plurality of apertures extending radially through the annular wall, the apertures each extending axially from a circumferentially smaller area to a circumferentially wider area, wherein an area of a transverse section through the annular wall at a position axially aligned with the circumferentially smaller areas is greater than an area of a transverse section through the annular wall at a position axially aligned with the circumferentially wider areas, wherein the annular wall is configured to shear at an axial location aligned with the plurality of apertures.

2. The containment structure of claim 1, wherein the annular wall receives an array of turbine blades.

3. The containment structure of claim 1, wherein each of the apertures have a triangular profile.

4. The containment structure of claim 3, wherein the triangular profile is a 45°-45°-90° triangular profile.

5. The containment structure of claim 3, wherein a point of the triangular profile is positioned upstream relative to other portions of the apertures.

6. The containment structure of claim 1, wherein the axial location aligned with the circumferentially wider areas of the plurality of apertures.

7. The containment structure of claim 1, wherein each of the apertures extending radially through the annular wall is axially aligned, and a circumferential distance between circumferentially adjacent apertures in the array of apertures is varied at different axial positions.

8. A turbomachine assembly, comprising:

a containment structure circumscribing a rotatable assembly of a turbomachine;

an array of apertures each extending radially through a wall of the containment structure and extending axially from a first axial end portion to a second axial end portion, the array of apertures providing a frangible joint that is axially aligned with the first axial end portions, the frangible joint being an area of the containment structure that is more frangible than an area of the containment structure that is aligned with the second axial end portions.

9. The turbomachine assembly of claim 8, wherein the containment structure is configured to shear near the frangible joint under a torque load.

10. The turbomachine assembly of claim 8, wherein the apertures have a triangular profile.

11. The turbomachine assembly of claim 8, wherein the containment structure is secured directly to an exhaust section of an auxiliary power unit.

12. The turbomachine assembly of claim 8, wherein the array of apertures are axially aligned.

13. The turbomachine assembly of claim 8, wherein the first axial end portions are downstream from the second axial end portions relative to a general direction of flow through the turbomachine.

14. The turbomachine assembly of claim 8, wherein the array of apertures are the only apertures extending radially through the containment structure, and the array of apertures are axially aligned.

15. The turbomachine assembly of claim 8, wherein a circumferential distance between circumferentially adjacent apertures in the array of apertures is varied at different axial positions.

16. A method of absorbing loads within a turbomachine, comprising:

applying a load to an containment structure; and shearing the containment structure at location of a frangible joint of the containment structure, the frangible joint provided by a first portion of the containment structure that is at least partially axially aligned with an array of apertures in the containment structure, the first portion of the containment structure having a transverse cross-sectional area that is less than a transverse cross-sectional area of a second portion of the containment structure, the second portion is at least partially axially aligned with the array of apertures.

17. The method of absorbing loads of claim 16, including applying the load with a component that has separated from a portion of an auxiliary power unit.

18. The method of absorbing loads of claim 16, wherein the array of apertures are axially aligned and extend axially through the containment structure.

19. The method of absorbing loads of claim 16, wherein the first portion is downstream from the second portion relative to a general direction of flow through the turbomachine.

* * * * *